US005529004A

United States Patent [19]

Porter et al.

[11] Patent Number: 5,529,004

[45] Date of Patent: Jun. 25, 1996

[54] METHOD AND APPARATUS FOR MANIPULATING AND SEWING FLEXIBLE FABRICS

[75] Inventors: Michael R. Porter, Topsfield, Mass.; Steven Marcangelo, Derry, N.H.; John J. Kirby, South Hamilton; Charles E. Mulcahey, Beverly, both of Mass.

[73] Assignee: Porter Sewing Machines, Inc., Beverly, Mass.

[21] Appl. No.: 210,881

[22] Filed: Mar. 17, 1994

[51] Int. Cl.[6] ..... D05B 21/00; D05B 27/04

[52] U.S. Cl. ..... 112/470.03; 112/306; 112/309; 112/470.07; 112/475.04

[58] Field of Search ..... 112/262.3, 306, 112/308, 309, 318, 320, 322, 121.11, 121.12, 275, 277, 272, 470.03, 475.04

[56] References Cited

U.S. PATENT DOCUMENTS

| | | | |
|---|---|---|---|
| 1,947,058 | 4/1929 | Pittoni . | |
| 3,013,513 | 12/1961 | Judelson | 112/306 |
| 4,043,282 | 8/1977 | Fanghanel . | |
| 4,067,269 | 1/1978 | Fanghanel . | |
| 4,141,304 | 2/1979 | Masuda | 112/308 X |
| 4,498,404 | 2/1985 | Sadeh | 112/308 X |
| 4,742,789 | 5/1988 | Pestel et al. | 112/308 X |
| 4,794,873 | 1/1989 | Dordi et al. . | |
| 4,813,364 | 3/1989 | Boser | 112/308 X |
| 4,821,656 | 4/1989 | Dordi et al. . | |
| 4,825,787 | 5/1989 | Babson et al. . | |
| 4,827,856 | 5/1989 | Rohr | 112/306 X |
| 4,838,186 | 6/1989 | Resta et al. . | |
| 4,905,615 | 3/1990 | Pofferi . | |
| 4,958,579 | 9/1990 | De Weers . | |
| 5,289,788 | 3/1994 | Fukumoto | 112/306 X |

FOREIGN PATENT DOCUMENTS

| | | |
|---|---|---|
| 0264618A1 | 4/1988 | European Pat. Off. . |
| 0330285A1 | 8/1989 | European Pat. Off. . |
| WO92/12282 | 7/1992 | WIPO . |

*Primary Examiner*—Peter Nerbun

*Attorney, Agent, or Firm*—Wolf, Greenfield & Sacks

[57] ABSTRACT

A method and apparatus for maniuplating and sewing first and second panels together is disclosed including a rotatable arm for rotating a first panel and control means for reducing the stitching speed in response to detection of a comer of the first panel.

13 Claims, 14 Drawing Sheets

METHOD AND APPARATUS FOR MANIPULATING AND SEWING FLEXIBLE FABRICS

FIELD OF THE INVENTION

This invention relates to a method and apparatus for manipulating a flexible fabric and, more particularly, to a machine that manipulates a top panel of a mattress sack so that all edges thereof may be automatically joined to a side panel.

BACKGROUND OF THE INVENTION

Modern mattresses generally include an inner construction and a mattress sack that completely covers the inner construction. The sack is secured to the inner construction by means of a flange which is connected to the inner construction using hog rings or the like.

The ticking material of a mattress sack may be of many types, such as flat or quilted, and the sack generally includes identical top and bottom panels and a side panel, joining the top and bottom panels. The top and bottom panel may be sewn directly to the side panel, joined with boarder tape, or attached with a gusset.

To reduce manufacturing cost, attempts have been made to automatically attach the side panel to the top panel. Typically, these attempts have held the inner construction stationary on a table and have positioned the mattress sack over the inner construction. A self-propelled sewing machine then joins the side and top panel, by boarder tape for example, by moving around the table via a track mechanism. Many modifications to this basic structure have been made and will not be repeated here for the sake of brevity.

More recently, the basic principle of propelling the sewing machine around the mattress has been reversed: now, the mattress is moved, not the sewing machine. For example, U.S. Pat. No. 4,043,282 describes a mattress tape edge closing machine, in which the mattress and cover are lifted at an angle with respect to a stationary machine. The mattress is then moved past the machine. In addition, U.S. Pat. No. 4,838,186 describes a sewing machine, including presser elements rotatably supported about a vertical axis to allow rotation of the mattress sack. Furthermore, U.S. Pat. No. 4,958,579 describes a device for sewing the edges of a mattress cover on an inner construction, including a swingable arm for rotating the mattress construction.

Some of these machines are cumbersome because they operate on the entire mattress construction. Others have difficulty maintaining high quality "sizing", a necessity in the mattress field. "Sizing" is a term known in the art and is used to refer to the uniformity of a mattress's stitching and dimensions, and more generally to its appearance.

Those skilled in the art will appreciate that a low cost and reliable machine for forming mattress sacks is needed.

Therefore, it is an object of the invention to provide a low cost machine for manipulating flexible fabrics, yet maintaining high quality sizing.

It is a further object of the invention to provide a method and apparatus for manipulating mattress sacks and other flexible fabrics, such that the feeding of the material to the apparatus is automatically monitored and corrected to insure high quality sizing.

It is yet another object of the present invention to prepare the panel to ensure that panel filling does not protrude from the ticking layer.

SUMMARY OF THE INVENTION

These and other objects are achieved with a method and apparatus for manipulating flexible fabrics, such as a top panel of a mattress sack. The invention works in conjunction with a conventional sewing machine, which is used to join the top panel and a side panel. The joining process may be of several types, including directly sewing together the two panels and a flange, joining the two panels and a flange with border tape, or joining the two panels and a flange with a gusset. In each case, the conventional sewing machine used must have the necessary apparatus for receiving and joining the side panel and other joining materials, e.g., border tape. Certain modifications are made to the conventional machine, which will be described below.

A top panel is pulled along a work surface by the feeding mechanism of the sewing machine. An edge of the top panel is joined to an edge of the side panel by known techniques. This joining proceeds along the entire length of the edge. The invention then detects an end of the edge and automatically manipulates the top panel so that a subsequent edge may be joined.

One aspect of the invention includes a detector to detect when the end of the edge that is being joined is a fixed distance from the needle of the sewing machine. At such time, the invention sends an indicative signal to the sewing machine so that it may slow the stitching speed during the manipulation of the panel. Another aspect of the invention includes a pivot arm that is lowered into engagement with the top panel proximal to the sewing machine. The pivot arm engages the top panel near a corner thereof, about which point of contact the panel is rotated. Preferably, it includes a bearing mechanism to allow easy rotation.

Another aspect includes a detector to detect when an end of the edge of the top panel that is being joined is a second fixed distance from the needle. A controller receives a signal from the detector and causes a mover arm to engage the top panel. The arm is then rotated, which causes the panel to rotate. Upon completion of the rotation, a subsequent edge of the top panel is positioned ready for subsequent joining with a remaining portion of the side panel.

To ensure that the top panel is being received properly, another aspect of the invention includes an orientation detector mechanism for detecting the longitudinal orientation of the edge of the top panel that is being joined with the side panel. The orientation detector provides a signal, indicative of the orientation of the top panel, to the controller.

A correction wheel is used in conjunction with the orientation detector to properly align the top panel. The correction wheel is transversely spaced from the sewing needle relative to the feeding direction of the sewing machine. The correction wheel includes a receiving wheel that engages the top panel and pulls the top panel toward the sewing machine in conjunction with the feeding mechanism of the sewing machine and in synchronism with the sewing machine. The speed of the receiving wheel is modifiable under the control of the controller.

The controller coordinates the operation of the correction wheel, relative to the orientation of the top panel. If the controller receives a signal from the orientation detector, indicating that the edge of the top panel is misoriented with respect to a "true direction," the controller may either speed up or slow down the speed of the receiving wheel. The torque that results from the receiving wheel operating at a speed different than that of the feeding mechanism of the sewing machine causes the top panel to rotate. Thus, by modifying the speed of the receiving wheel, the controller can cause the panel to be moved into alignment.

To ensure that the sewn edges will not be bunched, another aspect of the invention includes a fabric flattener for urging fill within the top panel toward a cut edge of the top panel. The flattener is positioned prior to the sewing needle and has a helical shape with the narrowest portion positioned inwardly, toward the center of the top panel. The flattener engages the top panel and rotates, causing the helical shape to urge the fill outwardly.

The flattener works in conjunction with a panel cutter placed transversely with respect to the sewing needle. The panel cutter works in timed relation with the needle such that, as the needle joins the materials, the panel cutter cuts the materials a fixed distance from the needle. This cutting operation provides uniform sizing by ensuring that the materials are joined at a fixed distance from the cut edge. The panel cutter also ensures that any protruding fill, resulting from the flattener, is also cut. The panel cutter, however, does not require the presence of the flattener, and may be used without it.

To ensure a clean-cut of the flange, another aspect of the invention includes a flange cutter for cutting the flange transversely at the end of the application.

The present invention also relates to a method for joining the top panel and side panel, which includes the following steps: (a) feeding a top panel to a sewing machine; (b) feeding a side panel to the sewing machine; (c) sewing an edge of the top panel to an edge of the side panel; (d) detecting a corner of the top panel; and (e) in response to detecting the corner, rotating the top panel so that a subsequent edge of the top panel may be sewn to the edge of the side panel. This method may also include further aspects, such as the following: detecting the longitudinal orientation of the top panel with respect to a true direction; and correcting the orientation of the top panel to be in alignment with the true direction.

BRIEF DESCRIPTION OF THE DRAWING

The invention will be more fully appreciated from the following detailed description when taken in conjunction with accompanying drawings, in which.

DETAILED DESCRIPTION

The present invention relates to a method and apparatus for manipulating a flexible material, such as a top panel of a mattress sack, so that all edges of the top panel may be automatically joined to a second material, such as a flange. A conventional sewing machine, with certain modifications, as described below, is used to join the top and side panels. The sewing machine receives the fabrics with appropriate feeding mechanisms for the material to be joined. The invention senses when the end of the edge of the top panel that is being joined is a fixed distance from the sewing machine needle. The invention then causes the sewing machine to slow the stitching speed. After the panel has moved a second fixed distance, the invention then causes a pivot arm to engage the panel and the invention then causes a mover arm to engage the top panel and rotate. Consequently, the top panel is rotated, with a subsequent edge of the top panel ready to be joined. The conventional sewing machine may be programmed to count stitches to determine when all edges of the top panel are completely joined to the second material. Though the description refers to panels used in constructing mattress sacks, the invention may also be used in the production of other flexible fabric products, such as bedspreads.

Figure 8:
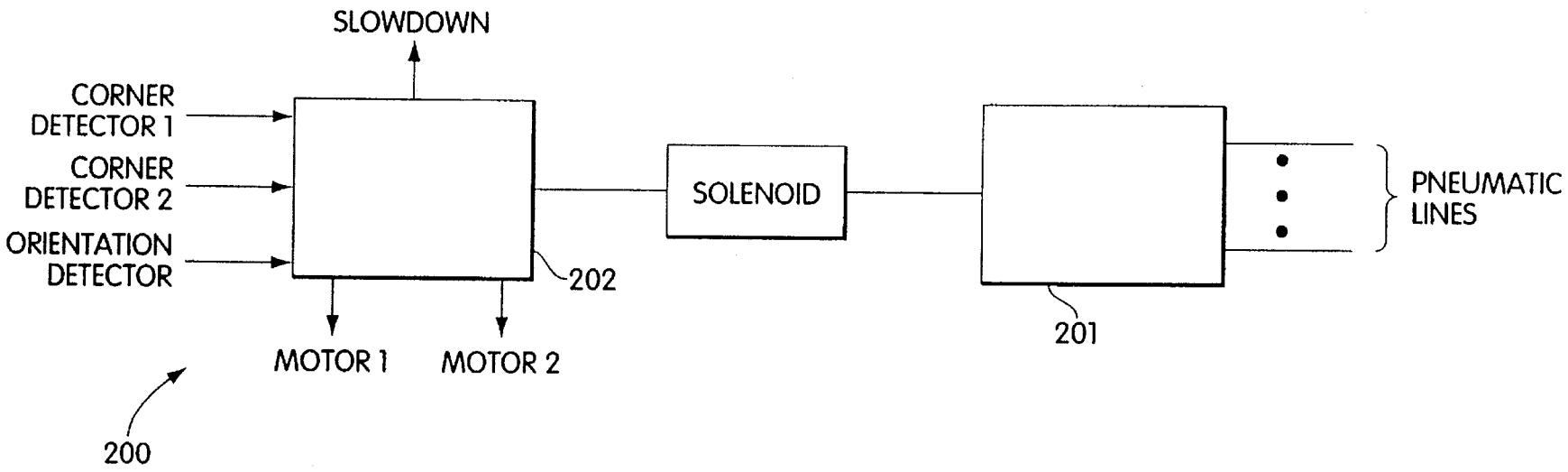
FIG. 8 is a block diagram showing operation of the controller.

The invention, including machine 10 and associated controller 200, will now be described with particular reference to FIGS. 1, 1A, and 8. Machine 10 includes stitcher 80, corner detectors 40*a* and 40*b*, pivot arm 50, mover arm 20, rotatable member 35, shoe 60, detector array 70, and correction wheel 30 in relation to a work surface 11 and a frame 5. Controller 200 provides electronic control signals and pneumatic pressure to various air lines for the components described below. The construction of the pneumatic logic 201 and electronic logic 202 will be apparent upon reading the description herein.

The table has a work surface 11. In a preferred embodiment the table is an air table.

Figure 1:
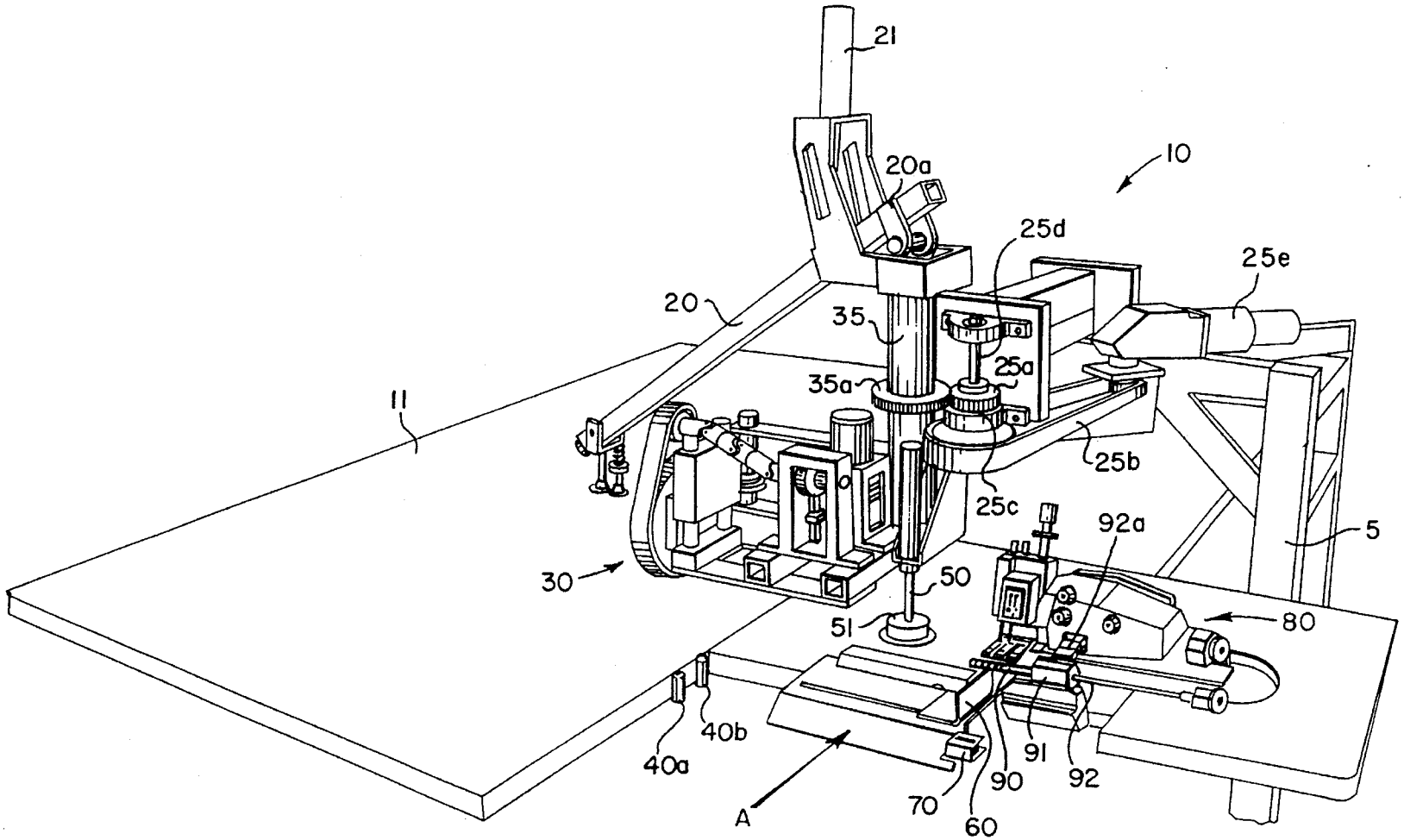
FIG. 1 is a first perspective view of the apparatus of this invention.
Figure 1A:
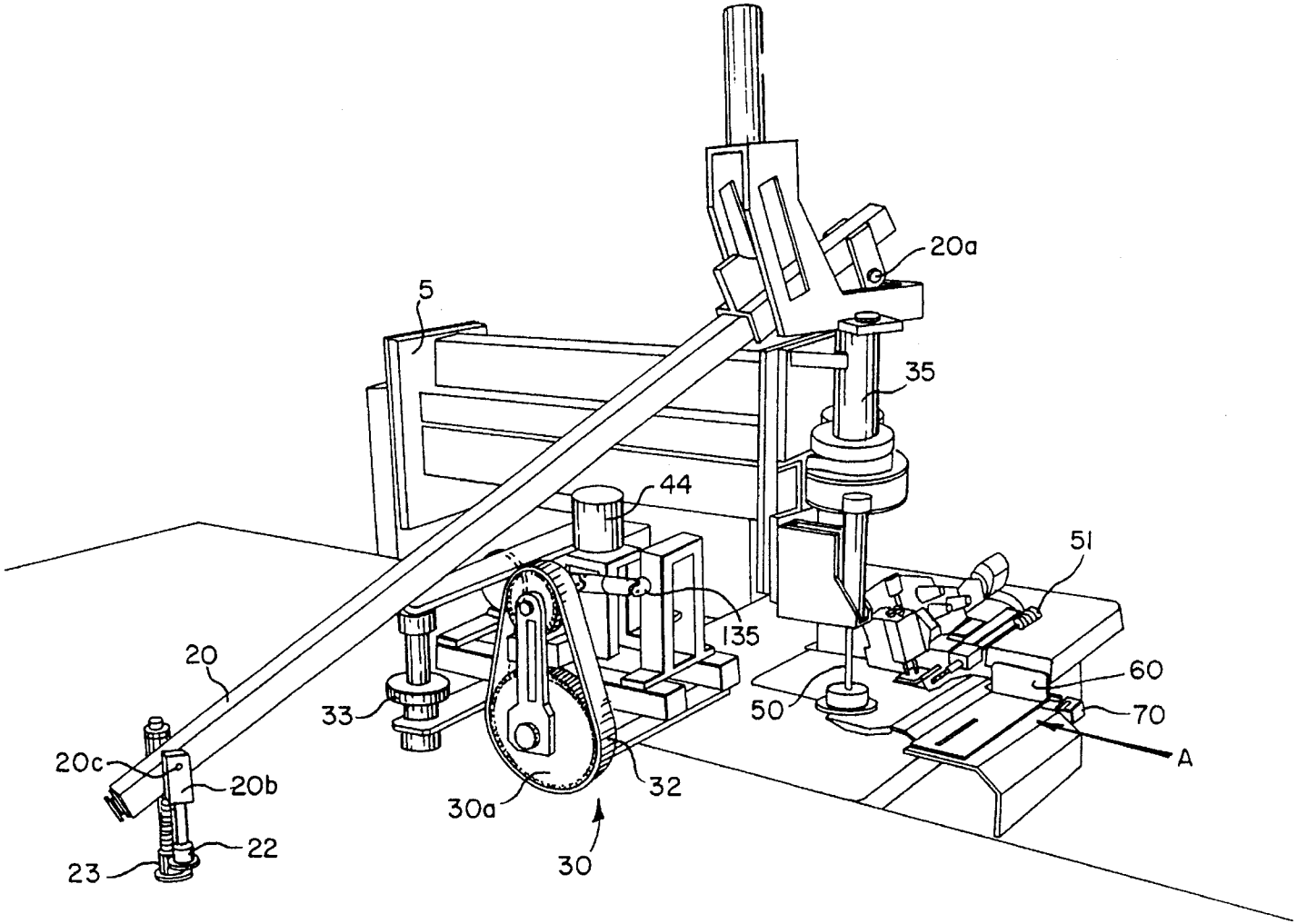
FIG. 1A is a second perspective view of the invention.

Referring to FIG. 1, the invention operates in conjunction with a conventional stitcher 80, which has certain modifications described below. An example is a machine such as the Porter 1000 or Porter 518 (which implements an overcast stitch), sold by Porter Sewing Machine, Inc., of Beverly, Mass. Other stitchers may be used to join the materials with border tape or with a gusset, for example. In a preferred embodiment, stitcher 80 includes a controller and encoder, so that stitches may be counted. Stitch counting may then used to determine when the top panel is completely joined. Because stitchers are known in the art, they will not be further discussed. In a preferred embodiment, stitcher 80 receives an electronic signal from controller 200, instructing the stitcher to slow the stitching speed, as discussed below.

Stitcher 80 ordinarily receives the materials along a true direction indicated as "A". The materials are joined along respective edges, with known techniques. A corner detector 40*a* is positioned at a fixed distance relative to the needle to detect the presence of a corner of the top panel. In a preferred embodiment, detector 40*a* is an ultrasound proximity detector and is fixed to a side of the work surface 11 five inches longitudinally from the needle. Other detectors may be substituted. The detector 40*a* provides a first indicative signal to the controller, upon detecting the corner.

Upon receiving the first indicative signal, the controller instructs the stitcher 80 to slow its stitching speed. This is done so that the stitcher will both stitch and pull the panel more slowly, while it's rotated, as described below.

A second detector 40*b* is fixed in a similar manner, preferably spaced 3 inches longitudinally from the needle. This detector provides a second indicative signal to the controller. Upon receiving the second signal, the controller causes a pivot arm 50 to lower into engagement with the top panel at a corner 300 (see FIG. 3A) defined by the edge that is being joined 301 and the edge 302 the proximity of which was detected by corner detector 40*a*. Pivot arm 50 includes a rotatable disc 51, which has a bearing to allow free rotation of the disc. The disc 51 provides a rotation point for the top panel to rotate about. The arm 50 and disc 51 are a fixed distance in transverse alignment with the needle, relative to direction A, so that the rotation point allows stitching to continue, while the panel is rotated.

Controller 200 causes a mover arm 20 to engage the top panel, in response to the second indicative signal. Mover arm 20 has a fulcrum 20*a* attached to a rotatable member 35. A cylinder mount 21*a* is attached to member 35 and is disposed on a distal side of fulcrum 20*a*. Mount 21*a* holds a pneumatic cylinder 21. Cylinder 21 is attached to mover arm 20, and thus, mover arm 20 is raised and lowered about fulcrum 20*a*, in response to the controller.

Figure 5:
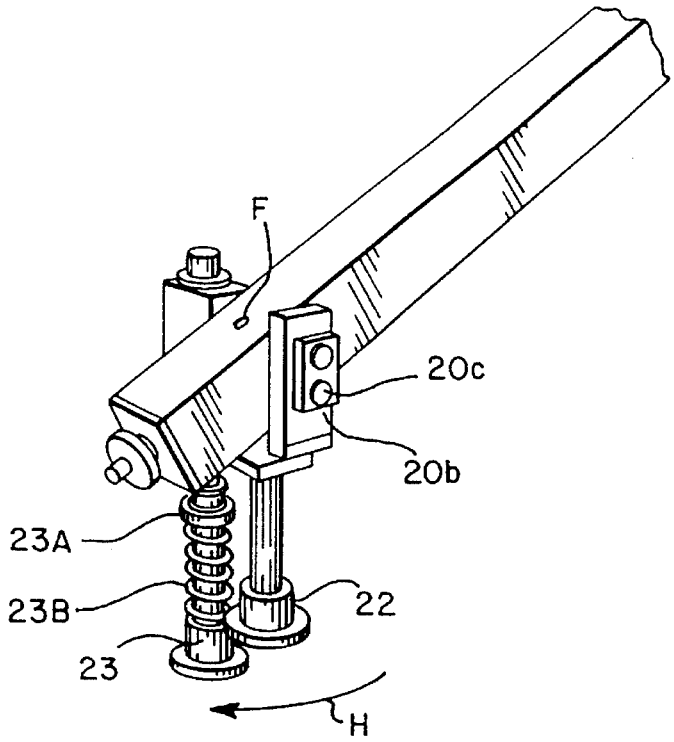
FIGS. 5, 5A, and 5B illustrate a solid foot and spring foot (engaging a panel)
Figure 5A:
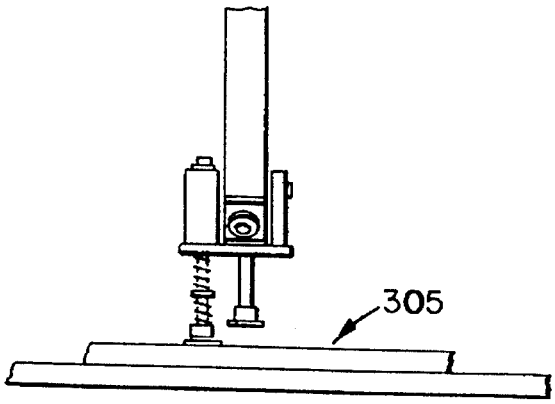
Figure 5B:
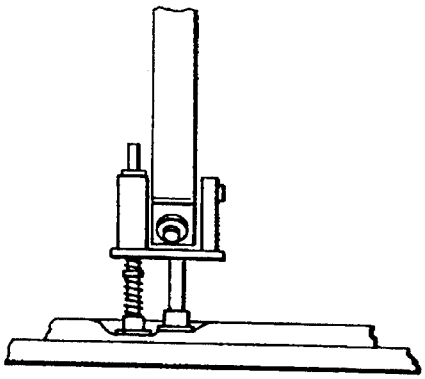

At the distal end of mover arm 20 are a solid foot 22 and a spring foot 23. These are shown in an enlarged view in FIG. 5. Spring foot 23 includes a compression spring 23B and a collar 23A which limits the amount of compression of spring 23B. Consequently, when mover arm 20 is lowered into engagement with the top panel 305, the spring foot first makes contact and compresses, and then, the solid foot makes contact, see FIGS. 5A and 5B. The two contact points provide a firm grip for rotating the panel.

Solid foot 22 and spring foot 23 are connected to yoke 206, which is attached to arm 20 by pivot shaft 20*c*. The pivot 20*c* allows yoke 20*b* to swing outward, as indicated by arrow H, when spring foot 23 makes contact with the top panel. This prevents the panel from rippling as shown by FIG. 5E, which may result from the downward and inward movement of arm 20, if the feet were rigidly fixed. Referring to partial cut-away view 5D, return spring 20*d* baises the yoke 20*b*.

The rotation of the mover arm 20 will now be described with reference to FIG. 1.

Frame 5 supports holds a gear drive 25*a* mounted with bearing 25*c* and attached to shaft 25*d*. Shaft 25*d* is rotated by belt 25*b*, in response to electric stepper motor 25*e*. Motor 25*e*, in turn, operates responsively to the controller. A gear 35*a* is fixed to rotatable member 35 and engages the gear drive 25*a*. As such, rotatable member 35 is caused to rotate under the control of the controller. When member 35 rotates, the mover arm 20 also rotates.

Figure 3A:
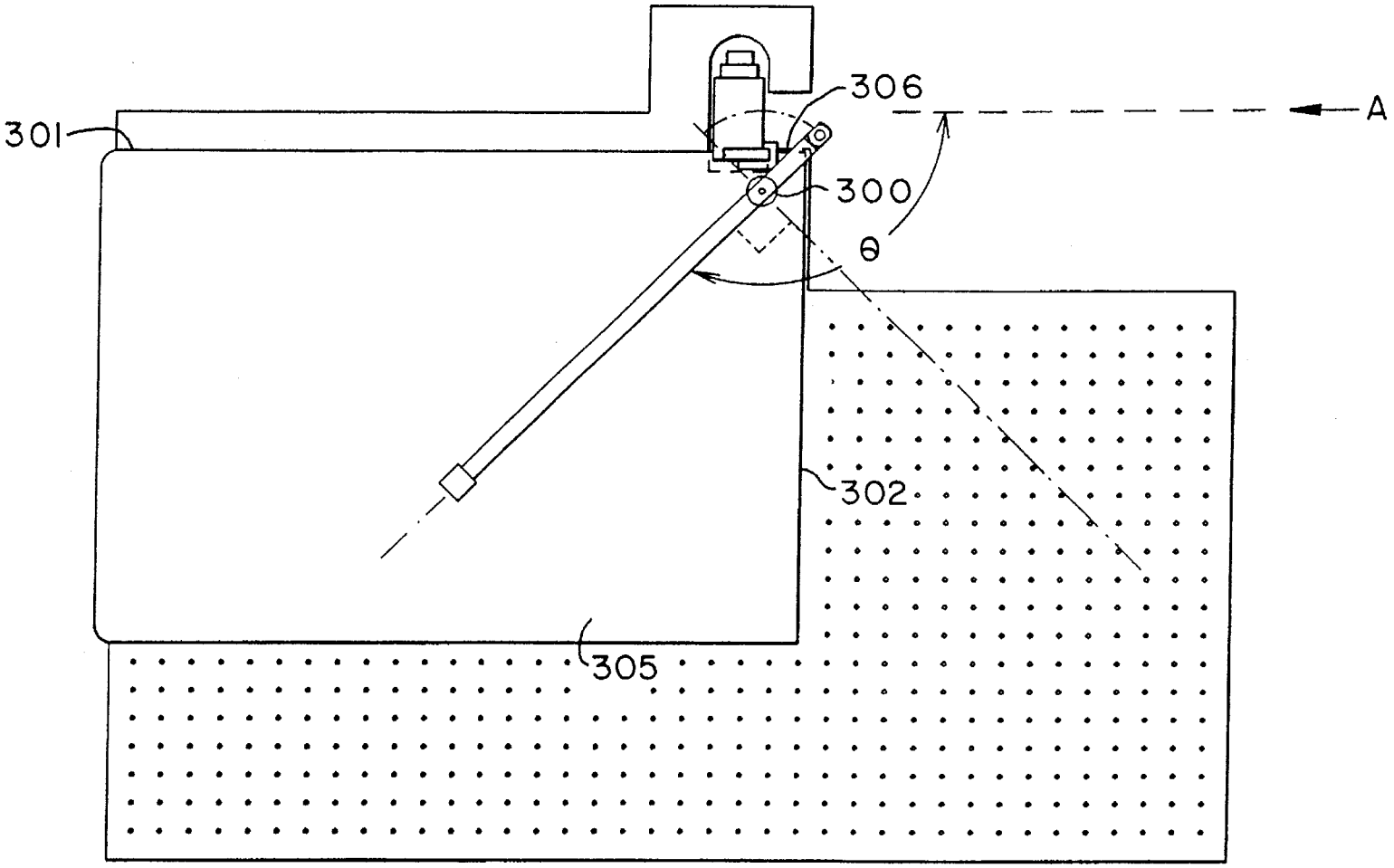
FIG. 3A–3C illustrate the turning operation of the method of this invention.
Figure 3B:
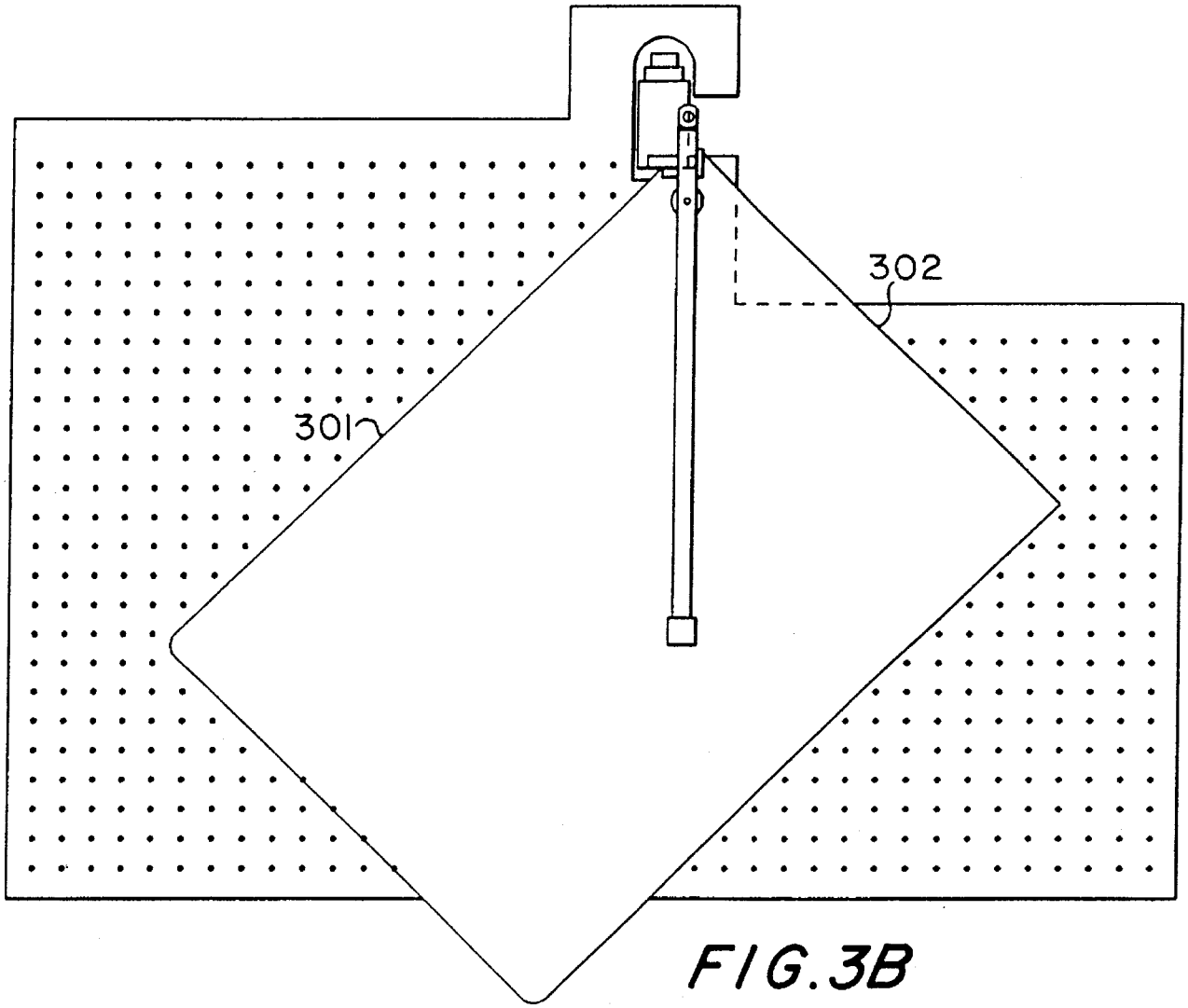
Figure 3C:
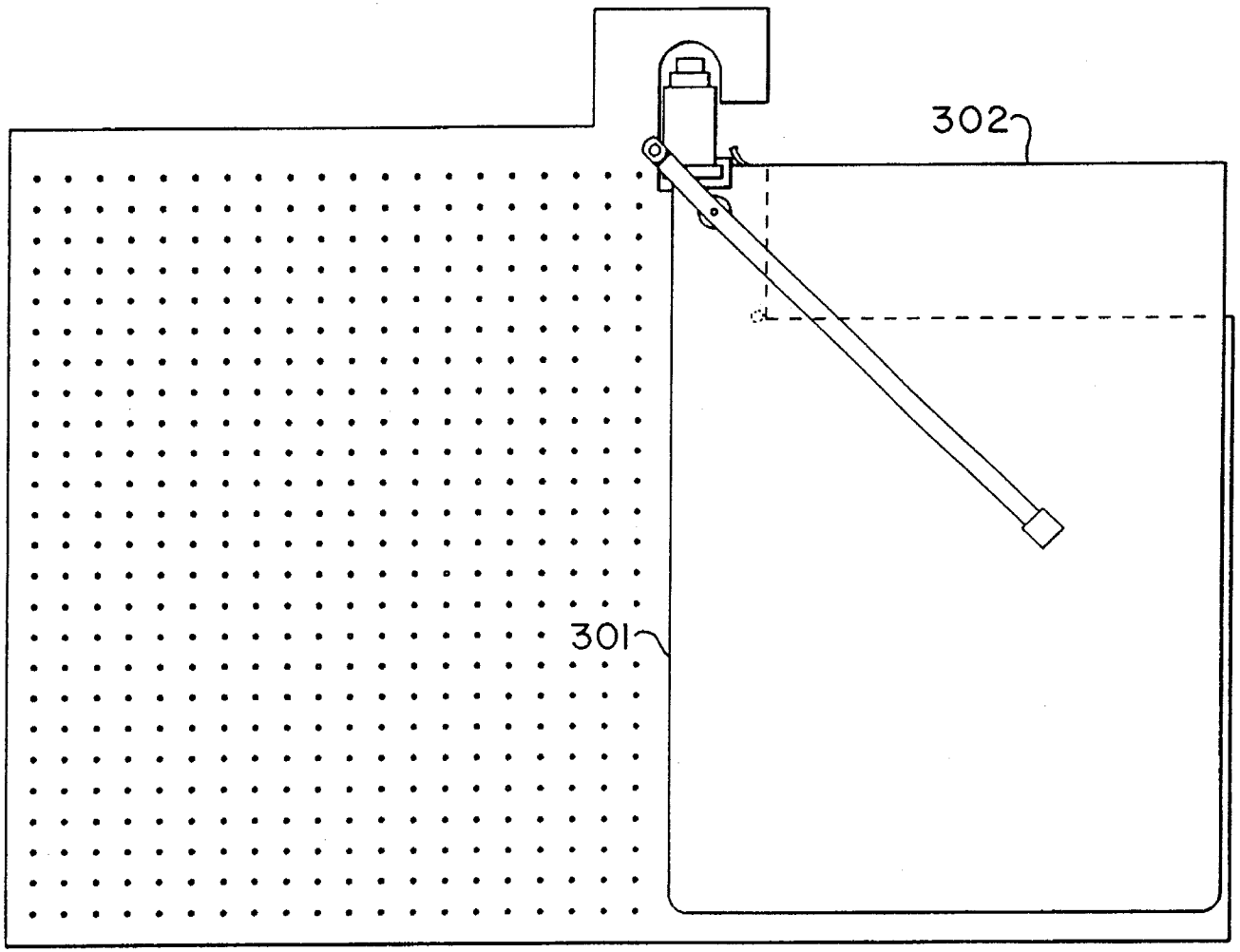

Referring to FIGS. 3A–3C, which are much-simplified, mover arm 20 preferably is disposed at an initial obtuse angle Θ relative to true direction A in its home position. FIGS. 3B and 3C respectively show the intermediate and final positions of panel 305, as it is pivoted through 90°. As can be seen, because of the positioning of arm 20 in its range of angles Θ to Θ-90°, arm 20 does not crowd or interfere with an operator in the proximity of stitcher 80.

The method of manipulating the panel will be described with reference to FIGS. 1–3. Materials are joined along an edge 301. When a corner 306 is detected, pivot arm 50 and mover arm 20 engage the panel 305 from the top and cause it to rotate. During the turning operation, the stitcher 80 operates at a reduced speed to stitch along the corners 306 of the panel. After which, a subsequent edge 302 is ready to be joined, the entire process being automated. Stitches are counted to determine the completion of the application.

Figure 5C:
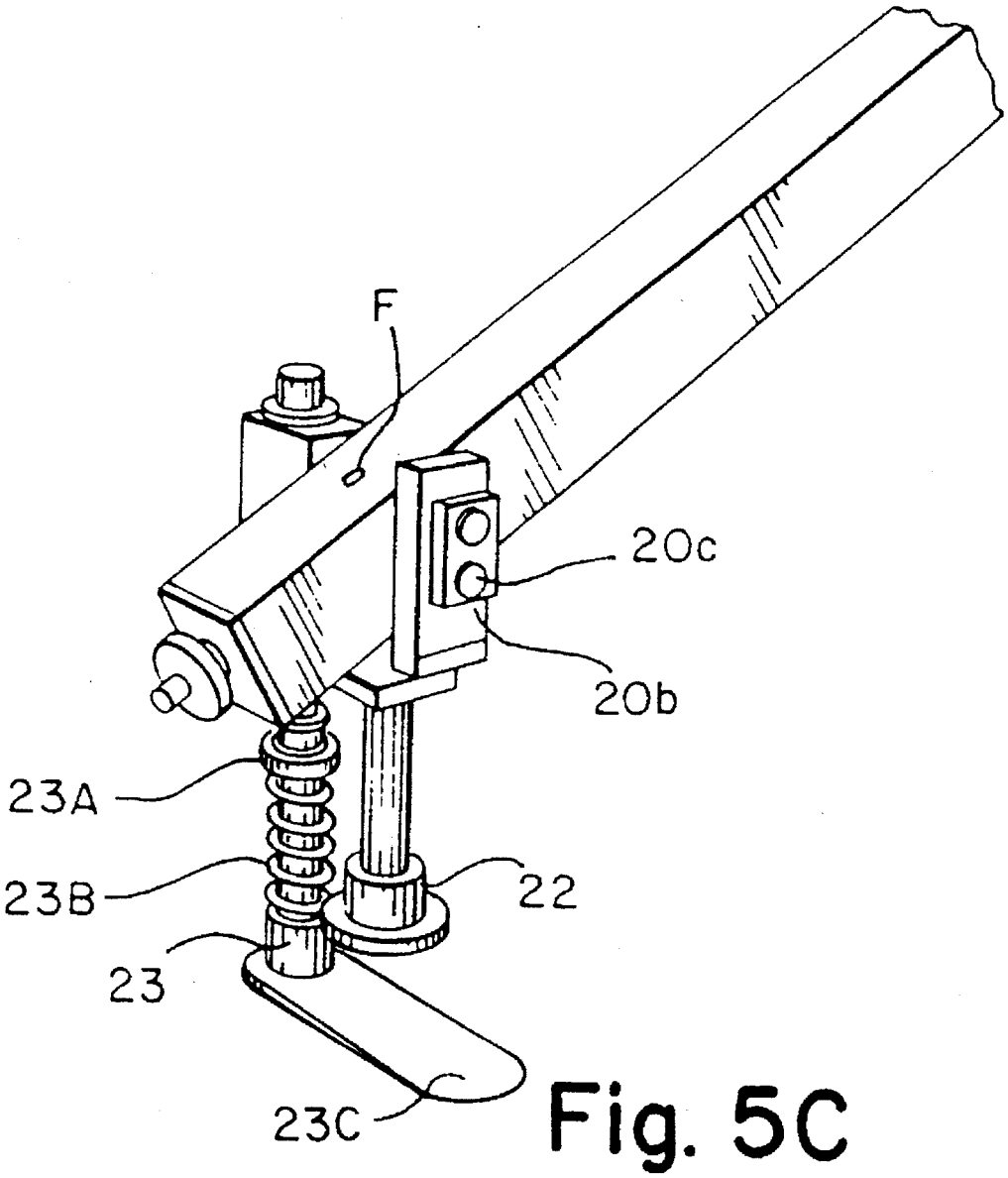
FIG. 5C illustrates an alternative embodiment of the distal end of the mover arm.
Figure 5D:
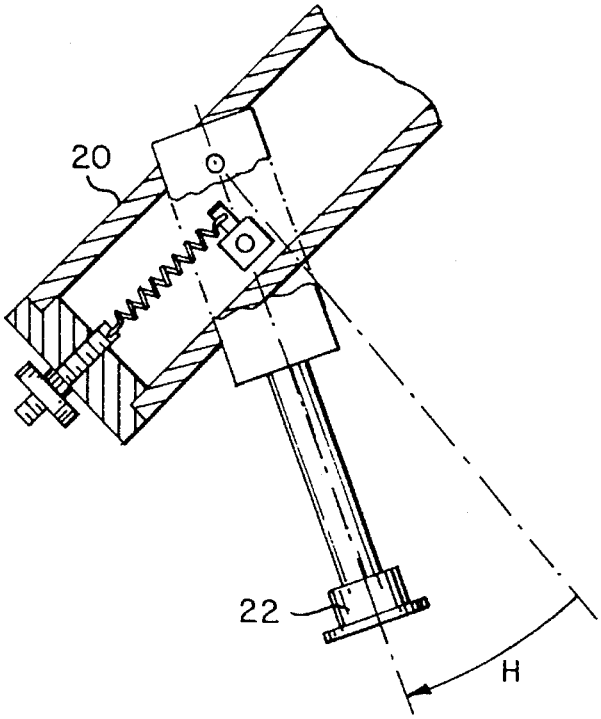
FIG. 5D is a partial cut-away view of a distal end of a mover arm of the apparatus of FIG. 1.
Figure 5E:
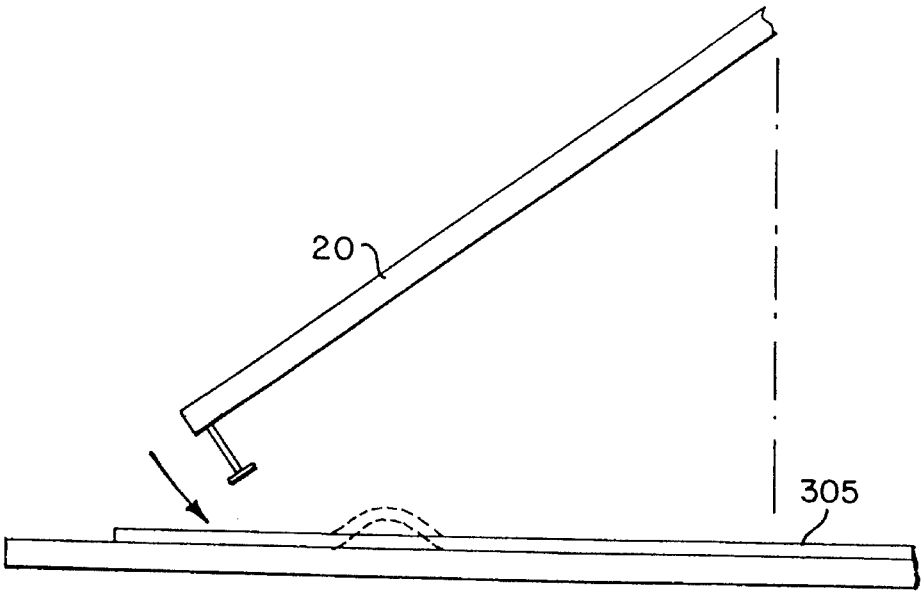
FIG. 5E illustrates panel bunching.

Alternatively, referring to FIG. 5C the spring foot 23 may be replaced by a shovel-foot having a shovel element 23C. Arm 20 would be positioned so that the shovel foot contacted the work surface 11. Arm 20 rotates so that the shovel 23C slides under the fabric, and the arm is subsequently lowered further so that the solid foot 22 engages the panel from above, while the shovel 23C engages from below. The arm would be initially positioned parallel to edge 301 of FIG. 3A. This type of grip is preferable for less stiff panels, such as bedspreads.

To achieve high quality sizing, other aspects of the invention, as described below, accurately feed the top panel to the stitcher. More particularly, mechanisms 60 and 70 are provided for monitoring the orientation of the top panel, and mechanism 30 is provided for adjusting the orientation, if misalignment occurs.

Figure 6:
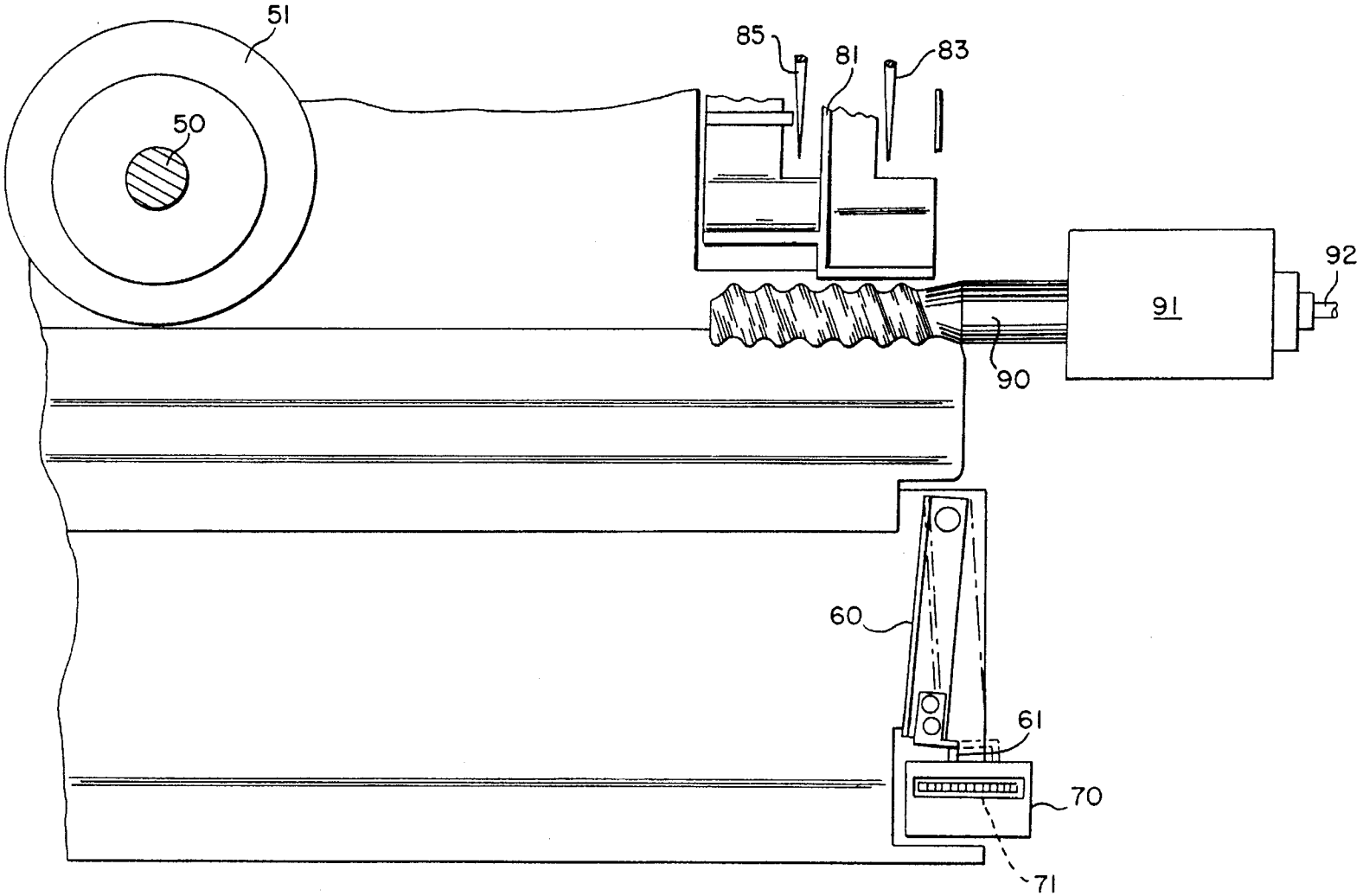
FIG. 6 is a top plan view which illustrates the panel flattener in relation to the shoe and panel cutter.
Figure 7:
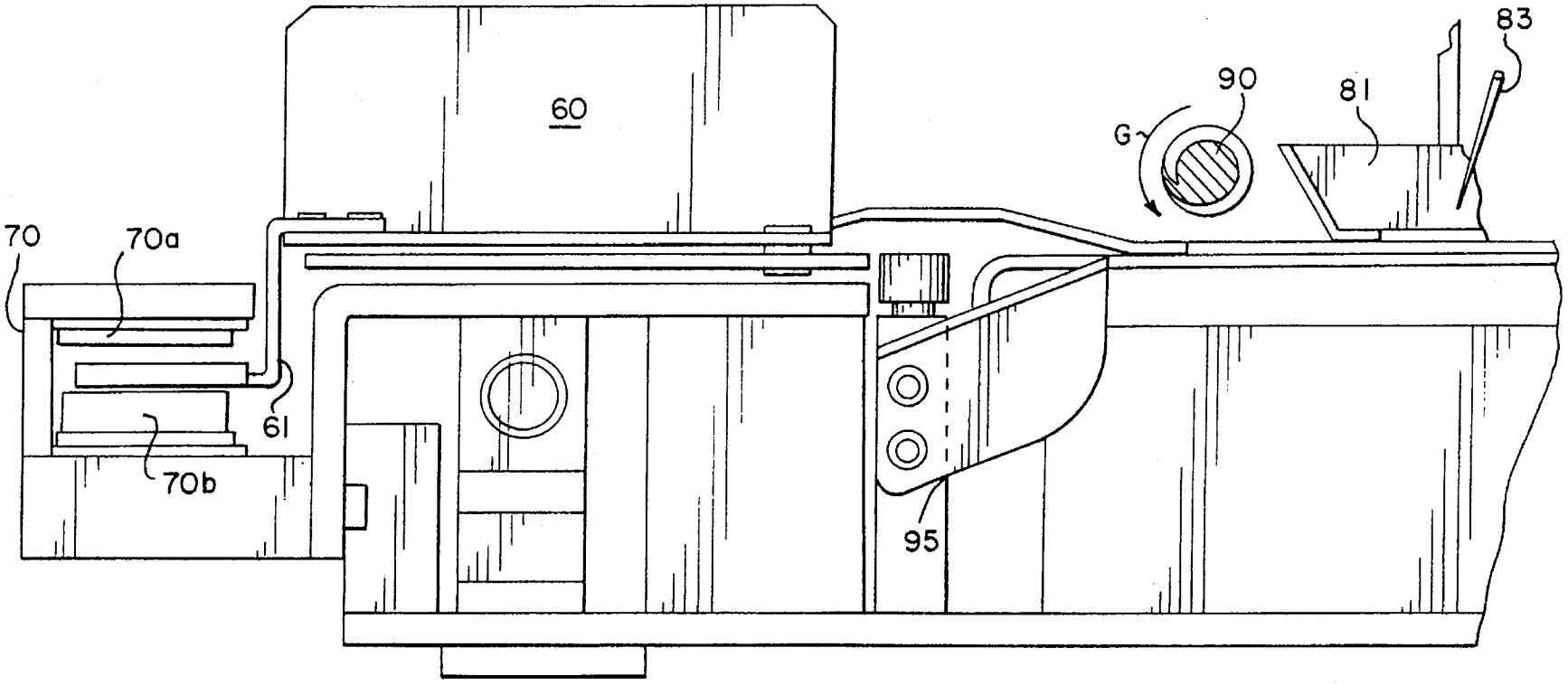
FIG. 7 is an enlarged side elevational view of the panel cutter in relation to the shoe, panel flattener and flange cutter.

Referring to FIGS. 1, 6 and 7 conjointly, a shoe 60 is pivotally mounted and spring biased to engage the edge 301 of the top panel that is being joined. The biasing force is sufficient to retain contact with the edge, but not enough to cause bunching or movement of the panel. As such, the shoe 60 follows the longitudinal orientation of the edge.

The shoe 60 includes a jog 61 that acts as a photo mask. A detector array 70 is disposed to monitor the jog 61. The array 70 includes photo emitting 70*a* and detecting mechanisms 70*b*, with the jog 61 placed therebetween. The initial position. 71 of jog 61 is centered in the array 70. Thus, if the shoe. 60 moves because the materials are fed at an angle relative to true direction A, detector array 70 detects more or less optical energy than that detected when the material is fed at a true direction A. As such, array 70 provides a signal indicative of the amount and direction of mis-orientation.

Alternative orientation detection techniques are known. In addition, for certain materials, particularly unfilled materials, a detector array may be used without a shoe apparatus. In these arrangement, the material, rather than the shoe, may act as a mask for the photo-detecting arrangement.

To adjust the orientation of the top panel, a correction wheel 30 is provided. Referring to FIGS. 1 and 2 conjointly, the correction wheel includes a receiving wheel 30*a* that may engage the panel as described below. By varying the rotational speed of the receiving wheel 30*a*, a torque may result from the force of the receiving wheel and the force of the stitcher's feeding mechanism. This torque causes the top panel to pivot slightly and may be used to correct the orientation of the top panel. The receiving wheel 30*a* is in transverse alignment with the needle, relative to direction A, so that the panel may be rotated into alignment about the needle. Thus, the panel will not be pulled from the needle.

Figure 2:
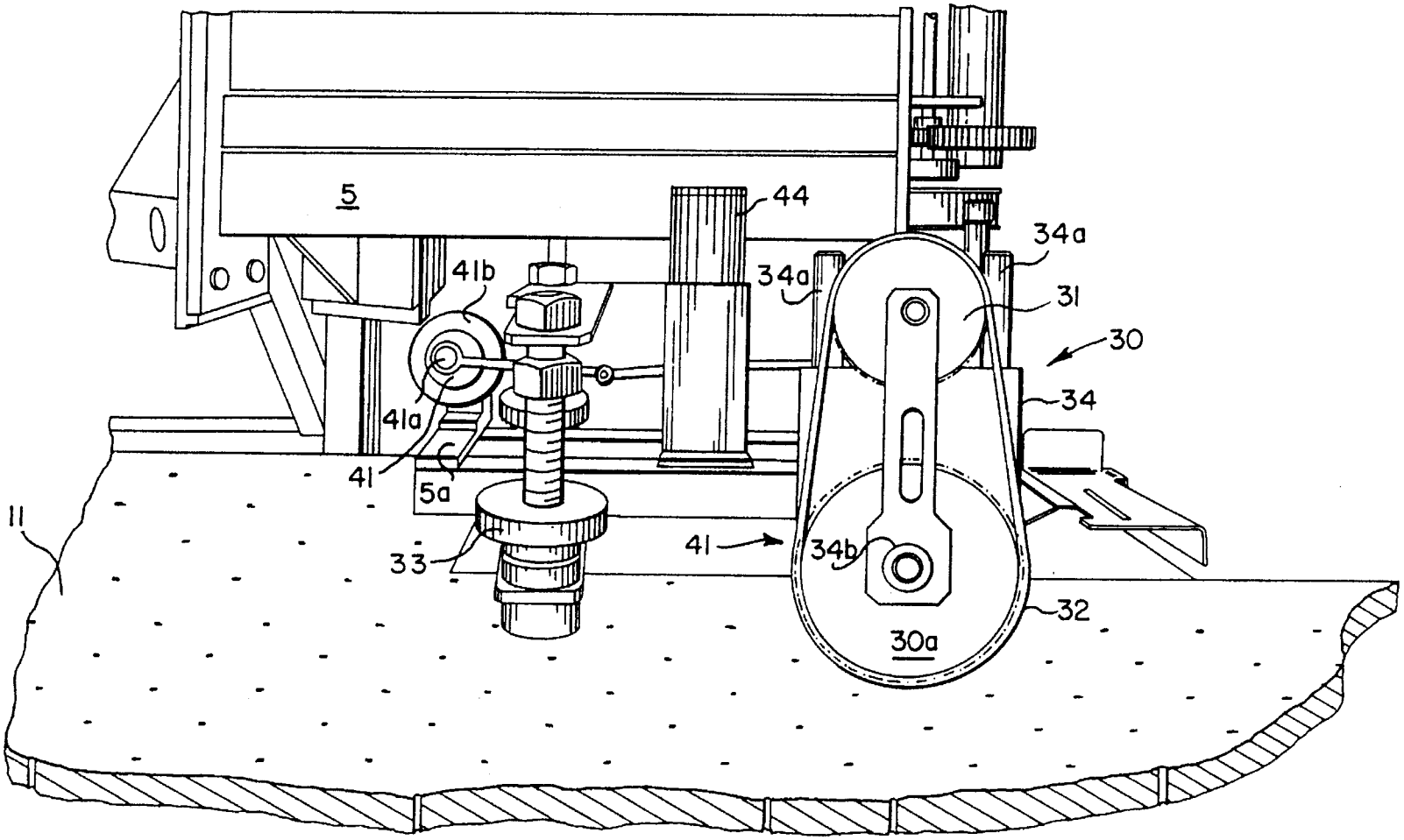
FIG. 2 is a side view of the apparatus of FIG. 1, including the correction wheel.

Referring to FIG. 2, the correction wheel includes a receiving wheel 30*a*, a drive wheel 31, and a belt 32. The receiving wheel 30*a* and the drive wheel 31 are connected by a member 34*b*, the combination 41 being attached to pneumatic lifter 34. The lifter 34 is raised or lowered on guide posts 34*a*, under the control of the controller 200. Vertical adjusters 33 are used to calibrate platform 5*a*, which holds the combination 41, in relation to frame 5. In this fashion, the combination 41 may be calibrated for different thickness panels. Drive wheel 31 is driven by a drive train 100, described below. Receiving wheel 30*a* is connected to drive wheel 31 via a belt 32, which in a preferred embodiment is rubberized and toothed. Belt 32 both connects the respective wheels and also provides a soft, yet firm grip on the top panels.

Figure 4A:
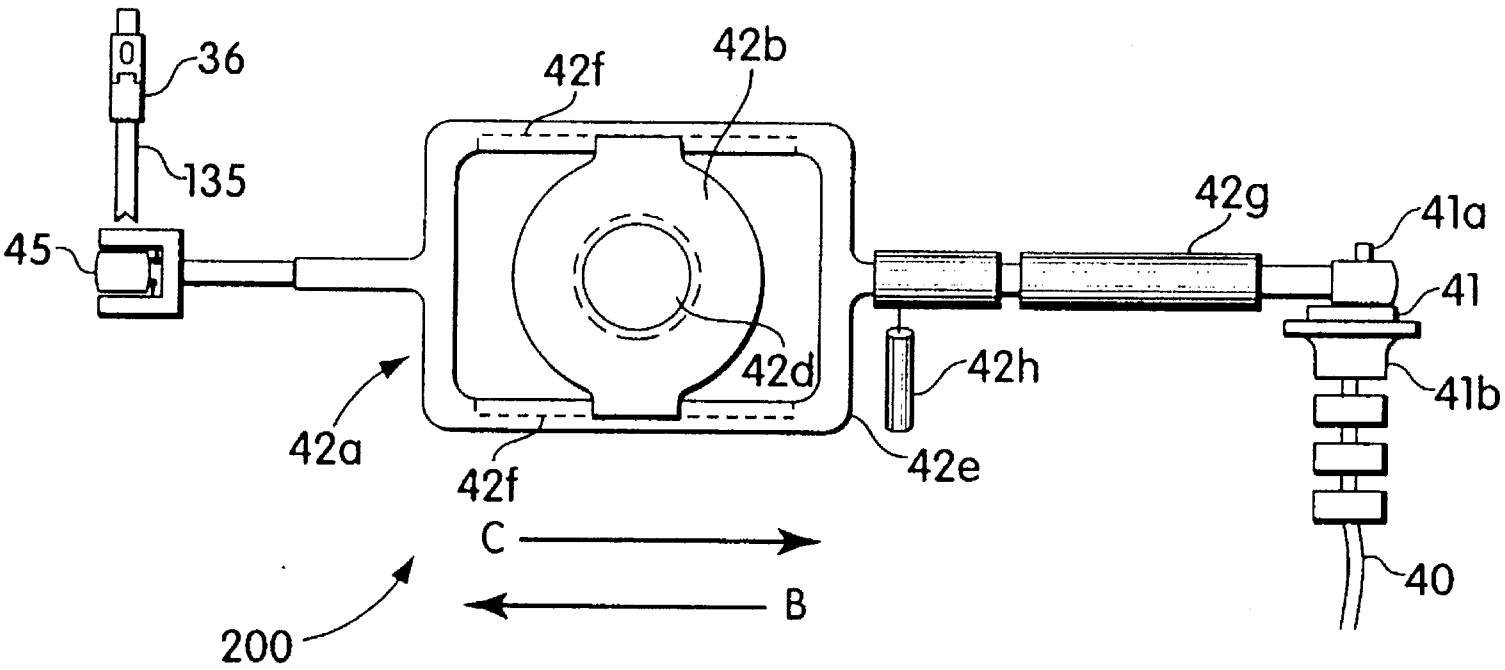
FIG. 4A is a top planar view which illustrates the drive train of the correction wheel.
Figure 4B:
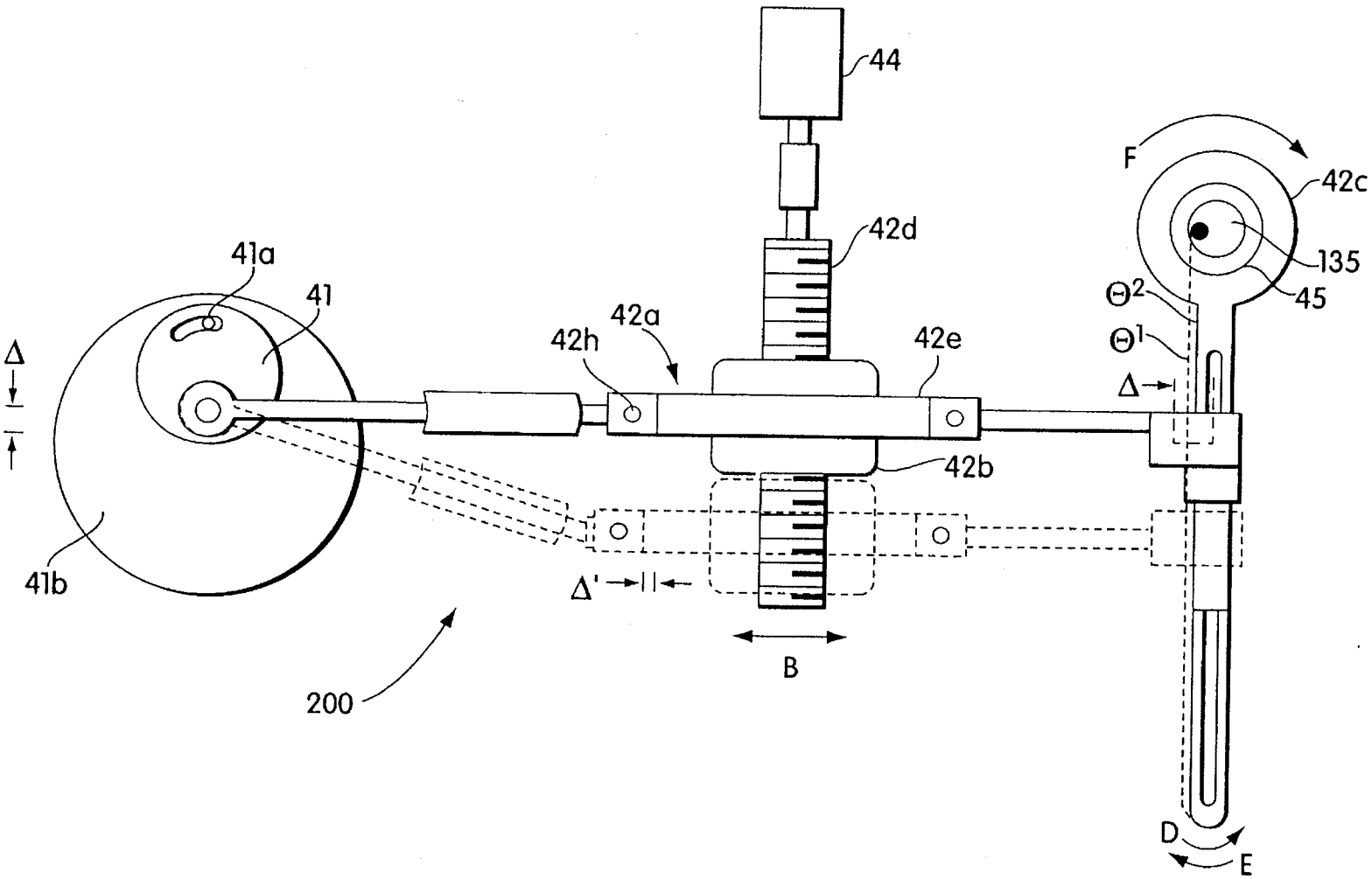
FIG. 4B is a side elevational view which illustrates the drive train of FIG. 4A.

Drive train 100 is mechanically coupled to a main shaft (not shown) of the conventional stitcher 80. In this fashion, the correction wheel 30 may be kept in synchronism with the feeding mechanism of the stitcher. Referring to FIGS. 4A–4B conjointly, drive train 100 includes flexible drive 40, main disk 41*b*, eccentric gear 41, carriage 42*a*, clutch 45, drive shaft 135, and universal 36. Flexible drive 40 is attached to the main shaft of the conventional stitcher, with known techniques. The other end of the flexible drive 40 is connected to a main disk 41*b* to which eccentric gear 41 is attached off center. The off center attachment causes pin 41*c* to move about the center of disk 41*b*. This causes the carriage 42*a* to rock back and forth, as indicated by B and C. For example, if the gear 41 is positioned off center 3/16 of an inch by adjusting pin 41*a*, the carriage will rock 3/8 of an inch (3/16 of an inch plus 3/16 of an inch). Carriage 42*a* has an opening with channels 42*f* for holding a fixed nut 42*b*. The channels 42*f* extend for substantially the length of carriage frame 42*e*. Carriage 42*a* rocks in direction of arrows B–C, while the nut 42*b* is held vertically stationary and slides within carriage 42*a*.

A carriage arm 42*g* is pivotally attached by pin 42*h* to frame 42*e*. The other end of carriage 42*a* is slidably attached to rocker arm 42*c*. Rocker arm 42*c* is caused to rock in direction of arrows D–E by the rocking motion of carriage 42*a*. In addition, rocker arm 42*c* is attached to a one-way clutch, such as a Torrington clutch 45, which receives the rocking motion D–E and translates it into a rotational motion in the direction shown by arrow F. The rotational speed is proportional to the speed of rocking motion D–E. Thus, the rotation of the main shaft (not shown) is translated into a rotational motion F at the output of clutch 45.

The nut 42*b* is engaged with a lead screw 42*d*, which is attached to electric stepper motor 44, controlled by the controller 200. Thus, controller 200 causes the lead screw to rotate, thus raising or lowering the nut 42*b* and the carriage 42*a*. See phantom of FIG. 4B for example alternative position of carriage 42*c*. By raising or lowering the carriage 42*a*, the amount of angular rotation of the rocker arm 42*c* is affected. By lowering the carriage 42C a smaller angular rotation $\Theta_2$ is covered in the same time as above for $\Theta_1$. Consequently, the controller changes the rotational speed at the output of clutch 45 by stepper motor 44. Drive wheel 31 is driven by a drive shaft 135, which is attached to the output of clutch 45.

Shaft 135 includes universal 36 to allow the correction wheel 30 to be raised and lowered relative to the working surface 11. The correction wheel 30 is pneumatically raised or lowered by pneumatic lifter 34, as described above. The wheel 30 is placed in the lowered state, during the stitching operation, so that the panel may be adjusted. The wheel 30 is placed in the raised state, during the turning operation, so that the panel may be rotated freely without friction from the receiving wheel 30*a*.

Correction wheel 30 corrects any misalignment of the edge of the top panel by having the speed of the receiving wheel 30*a* appropriately adjusted. As a result, even if the top panel 305 is slightly mis-rotated by the mover arm 20, i.e., to something other than 90°, correction wheel 30 may adjust the panel.

The method of correcting the orientation will be described with reference to FIGS. 1, 2, and 4A–B. The panel is pulled toward stitcher 80 by a feed mechanism (not shown) of the stitcher and by a receiving wheel 30*a* engaged with the top panel 305. The receiving wheel 30*a* is mechanically coupled to a main shaft of the sewing machine and thus rotates, in synchronism with the feeding mechanism. The longitudinal orientation of the top panel 305 is monitored by a detector mechanism 60 and 70. In response thereto, the mechanical coupling of the receiving wheel 30*a* is modified to appropriately increase or decrease the rotational speed of the receiving wheel 30*a*. The resulting torque, caused by the receiving wheel 30*a* and the feeding mechanism of the stitcher, causes the panel to rotate into alignment.

In a preferred embodiment, the invention also includes a flange cutter 95. Referring to FIG. 7, pneumatic flange cutter 95 cuts the flange material at the end of the application, that is, after all edges are sewn. The cut is transverse to the longitudinal direction A. Consequently, the flange has a cleaner cut than that achievable when it is cut by hand.

Referring to FIGS. 6 and 7 conjointly, a preferred embodiment of stitcher 80 includes a Wilcox-Gibbs type cutter 81 to cut material longitudinally, as the material is stitched, to provide high quality sizing. Panel cutter 81 moves up and down in synchronism with a needle 83 of stitcher 80. As such, provides the ability to round the corners (307, FIG. 3A) of top panel 305, as they are rotated, and cuts an edge (301, see FIG. 3A) of the panel a fixed distance from the stitch. The cutter operates synchronously with the needle as is known in the art.

Depending on the type of panel used, polyfil or the like may protrude from the ticking layer of the panel 305. To flatten the edge 301 before the edge is eventually sewn, and in the process urge any protruding fill outwardly, a panel flattening apparatus 90 is provided. Referring to FIG. 6, panel flattener 90 is disposed prior to the needle 83, using a spring mount 91 which is provided to absorb vibrations. A pneumatic lifter 92*a* (see FIG. 1) is used to raise the flattener 90 to ease initial loading of a panel into the invention. Alternatively, the lifter 92*a* may be used to replace the spring mount by acting as an air spring. The flattener 90 is attached to the main shaft (not shown) with a flexible drive 92 so that it may synchronously rotate as shown by arrow G, as a counter to the feeding direction of the materials (see FIG. 7). In a preferred embodiment, flattener 90 has an auger-like shape, so that the screw-like edges and rotation may flatten the material and urge any fill toward the outer edge, where it may be eventually cut by a panel cutter 81. Alternatively, the flattener 90 may be a helical, wedge-shaped brush, or use similar helical structures.

In view of the above description, it is likely that modifications and improvements will occur to those skilled in the art, which should be deemed as being within the scope of this invention. The above description is intended to be exemplary only, the scope of the invention being defined by the following claims and their equivalents.

What is claimed is:

1. A machine for sewing together a first panel, which is filled with a material, and a second panel, said machine comprising:

a sewing machine for receiving and joining the panels; and an edge flattener disposed prior to the sewing machine along a feeding path of the panels, and including a rotatable component having an axis of rotation substantially perpendicular to the feeding path and a helical structure on an outer surface, the flattener including means for rotating the rotatable component to cause the helical structure to urge material within the first panel toward an outer edge of the first panel.

2. A machine for sewing together a first panel and a second panel, said machine comprising:

a sewing machine for receiving along a feed direction and joining together the first and second panels;

an arm having a longitudinal axis and being arcuately moveable about a fulcrum towards a surface of the first panel, a distal end of the arm being adapted to contact the surface of the first panel as the arm moves toward the surface of the first panel;

means for rotating the arm about an axis normal to the surface of the first panel to rotate the first panel when the distal end of the arm is in contact with the surface of the first panel;

a controller; and a first detector positioned a first fixed distance before the sewing machine along the feed direction for providing a first signal to the controller when the first detector detects a corner of the first panel, the controller causing the sewing machine to reduce its stitching speed in response to the first signal.

3. The machine of claim 2 further comprising a shoe biased to follow an edge of the first panel as the first panel is fed to the sewing machine;

a detector to monitor the shoe and provide a signal indicative of a longitudinal orientation of the edge of the first panel; and means for adjusting the longitudinal orientation of the first panel with respect to a true feed direction in response to the longitudinal orientation signal.

4. The machine of claim 3 wherein the adjusting means includes a receiving wheel engageable with the first panel, the receiving wheel being in alignment with the sewing machine along a direction transverse to the true feed direction.

5. The machine of claim 4 wherein the adjusting means further includes means for rotating the receiving wheel, the rotating means being coupled to a main shaft of the sewing machine and including means for varying a rotational speed of the receiving wheel.

6. The machine of claim 2 further comprising a second detector positioned a second fixed distance before the sewing machine along the feed direction for providing a second signal to the controller when the second detector detects a corner of the first panel, the controller causing the rotating means to rotate the first panel in response to the second signal.

7. The machine of claim 6 further comprising a second pivot arm engageable with the surface of the first panel in a position proximal to the sewing machine with respect to the distal end of the arm to provide a pivot point for rotation of the first panel, the second pivot arm engaging the surface of the first panel in response to the second signal.

8. A machine for sewing together a first panel and a second panel, said machine comprising:

a sewing machine for receiving and joining the first and second panels;

means for feeding the first and second panels to the sewing machine in a desired feed direction;

means for detecting an orientation of an edge of the first panel with respect to the desired feed direction; and means for correcting the orientation of the first panel edge to bring the first panel edge into alignment with the desired feed direction, said correcting means comprising:

a receiving wheel for engaging a surface of the first panel, the receiving wheel being in alignment with the sewing machine along a direction transverse to the desired feed direction; and a drive for rotating the receiving wheel, the drive being mechanically coupled to a main shaft of the sewing machine and including means for varying a rotational speed of the receiving wheel in response to the detecting means, the varying means including a carriage having a first end mechanically coupled to the main shaft of the sewing machine and a second end mechanically coupled to the receiving wheel, and a stepper motor for positioning the carriage in response to the detecting means, the position of the carriage corresponding to the rotational speed of the receiving wheel.

9. A machine for sewing together a first panel and a second panel, said machine comprising:

a sewing machine for receiving along a feed direction and joining together the first and second panels;

an arm having a longitudinal axis and being arcuately movable about a fulcrum towards a surface of the first panel, said arm having a distal end for contacting the surface of the first panel as the arm moves towards the surface of the first panel;

means for rotating the arm about an axis normal to the surface of the first panel to rotate the first panel when the distal end of the arm is in contact with the surface of the first panel;

a shoe biased to follow an edge of the first panel as the first panel is fed to the sewing machine;

a detector to monitor the shoe and provide a signal indicative of a longitudinal orientation of the edge of the first panel;

means for adjusting the longitudinal orientation of the first panel with respect to a true feed direction in response to the longitudinal orientation signal, said adjusting means including a receiving wheel engageable with the first panel, the receiving wheel being in alignment with the sewing machine along a direction transverse to the true feed direction.

10. The machine of claim 9 wherein the adjusting means further includes means for rotating the receiving wheel, the rotating means being coupled to a main shaft of the sewing machine and including means for varying a rotational speed of the receiving wheel.

11. A method for automatically sewing a first panel to a second panel, the method comprising the steps of:

automatically feeding the first and second panels to a sewing machine in a feed direction;

sewing the first panel to the second panel at the sewing machine at a first stitching speed;

detecting a corner of the first panel at a first predetermined distance before the sewing machine along the feed direction;

reducing a stitching speed of the sewing machine from the first stitching speed, to a second stitching speed in response to said first detecting step, the second stitching speed being slower than the first stitching speed;

detecting the corner of the first panel at a second predetermined distance before the sewing machine along the feed direction, the second predetermined distance being less than the first predetermined distance;

in response to said second detecting step, automatically rotating the first panel about the corner;

during said rotating step, sewing the first panel to the second panel at the second stitching speed; and after completion of said rotating step, increasing a stitching speed of the sewing machine from the second stitching speed to the first stitching speed.

12. The machine of claim 6 further comprising:

a pivot arm;

apparatus for lowering the pivot arm into engagement with the corner of the first panel in response to a signal received from the controller after the controller receives the second signal from the second detector; and a freely rotatable end of the pivot arm for engaging the first panel and rotating with the first panel, said end being adapted to allow the sewing machine to continue sewing around the corner during rotation of the first panel.

13. The machine of claim 2 wherein the controller operates the sewing machine at the reduced stitching speed during operation of the rotating means to rotate the first panel, and at a stitching speed greater than the reduced stitching speed after rotation of the first panel.

* * * * *